US006366188B1

(12) United States Patent
Hein et al.

(10) Patent No.: US 6,366,188 B1
(45) Date of Patent: Apr. 2, 2002

(54) ACCESSORY AND RECESS IDENTIFICATION SYSTEM FOR CIRCUIT BREAKERS

(75) Inventors: Richard L. Hein, Weatogue, CT (US); Michael H. Thomas, Amersfoort (NL); Kay Gruenwoldt, Middletown, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/526,995

(22) Filed: Mar. 15, 2000

(51) Int. Cl.[7] ..... H01H 9/02

(52) U.S. Cl. ..... 335/202; 335/132

(58) Field of Search ..... 335/132, 6, 202, 335/17; 200/293, 208

(56) References Cited

U.S. PATENT DOCUMENTS

| | | | | |
|---|---|---|---|---|
| 2,340,682 A | | 2/1944 | Powell | |
| 2,719,203 A | | 9/1955 | Gelzheiser et al. | |
| 2,937,254 A | | 5/1960 | Ericson | |
| 3,158,717 A | | 11/1964 | Jencks et al. | |
| 3,162,739 A | | 12/1964 | Klein et al. | |
| 3,197,582 A | | 7/1965 | Norden | |
| 3,307,002 A | | 2/1967 | Cooper | |
| 3,517,356 A | | 6/1970 | Hanafusa | |
| 3,631,369 A | | 12/1971 | Menocal | |
| 3,803,455 A | | 4/1974 | Willard | |
| 3,883,781 A | | 5/1975 | Cotton | |
| 4,129,762 A | | 12/1978 | Bruchet | |
| 4,144,513 A | | 3/1979 | Shafer et al. | |
| 4,158,119 A | | 6/1979 | Krakik | |
| 4,165,453 A | | 8/1979 | Hennemann | |
| 4,166,988 A | | 9/1979 | Ciarcia et al. | |
| 4,220,934 A | | 9/1980 | Wafer et al. | |
| 4,246,452 A | * | 1/1981 | Chandler | 200/5 A |
| 4,255,732 A | | 3/1981 | Wafer et al. | |
| 4,259,651 A | | 3/1981 | Yamat | |
| 4,263,492 A | | 4/1981 | Maier et al. | |
| 4,276,527 A | | 6/1981 | Gerbert-Gaillard et al. | |
| 4,297,663 A | | 10/1981 | Seymour et al. | |
| 4,301,342 A | | 11/1981 | Castonguay et al. | |
| 4,360,852 A | | 11/1982 | Gilmore | |
| 4,368,444 A | | 1/1983 | Preuss et al. | |
| 4,375,021 A | | 2/1983 | Pardini et al. | |
| 4,375,022 A | | 2/1983 | Daussin et al. | |
| 4,376,270 A | | 3/1983 | Staffen | |
| 4,383,146 A | | 5/1983 | Bur | |
| 4,392,036 A | | 7/1983 | Troebel et al. | |
| 4,393,283 A | | 7/1983 | Masuda | |
| 4,401,872 A | | 8/1983 | Boichot-Castagne et al. | |

(List continued on next page.)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |

(List continued on next page.)

*Primary Examiner*—Lincoln Donovan
(74) *Attorney, Agent, or Firm*—Cantor Colburn LLP

(57) ABSTRACT

An identification system for identifying correct placement of various circuit breaker accessories within recesses of a circuit breaker molded frame is disclosed. The system includes recess symbols adjacent the recesses in the frame and matching accessory symbols positioned on a front, visible surface of the accessories. The system may further include name labels positioned on the accessories for labeling the accessories' names. A circuit breaker employing the identification system of the present invention is also disclosed.

13 Claims, 6 Drawing Sheets

U.S. PATENT DOCUMENTS

| | | | | |
|---|---|---|---|---|
| 4,409,573 | A | | 10/1983 | DiMarco et al. |
| 4,435,690 | A | | 3/1984 | Link et al. |
| 4,467,297 | A | | 8/1984 | Boichot-Castagne et al. |
| 4,468,645 | A | | 8/1984 | Gerbert-Gaillard et al. |
| 4,470,027 | A | | 9/1984 | Link et al. |
| 4,479,143 | A | | 10/1984 | Watanabe et al. |
| 4,488,133 | A | | 12/1984 | McClellan et al. |
| 4,492,941 | A | | 1/1985 | Nagel |
| 4,541,032 | A | | 9/1985 | Schwab |
| 4,546,224 | A | | 10/1985 | Mostosi |
| 4,550,360 | A | | 10/1985 | Dougherty |
| 4,562,419 | A | | 12/1985 | Preuss et al. |
| 4,589,052 | A | | 5/1986 | Dougherty |
| 4,595,812 | A | | 6/1986 | Tamaru et al. |
| 4,611,187 | A | | 9/1986 | Banfi |
| 4,612,430 | A | | 9/1986 | Sloan et al. |
| 4,616,198 | A | | 10/1986 | Pardini |
| 4,622,444 | A | | 11/1986 | Kandatsu et al. |
| 4,631,625 | A | | 12/1986 | Alexander et al. |
| 4,642,431 | A | | 2/1987 | Tedesco et al. |
| 4,644,438 | A | | 2/1987 | Puccinelli et al. |
| 4,649,247 | A | | 3/1987 | Preuss et al. |
| 4,658,322 | A | | 4/1987 | Rivera |
| 4,672,501 | A | | 6/1987 | Bilac et al. |
| 4,675,481 | A | | 6/1987 | Markowski et al. |
| 4,682,264 | A | | 7/1987 | Demeyer |
| 4,689,712 | A | | 8/1987 | Demeyer |
| 4,694,373 | A | | 9/1987 | Demeyer |
| 4,710,845 | A | | 12/1987 | Demeyer |
| 4,717,985 | A | | 1/1988 | Demeyer |
| 4,733,211 | A | | 3/1988 | Castonguay et al. |
| 4,733,321 | A | | 3/1988 | Lindeperg |
| 4,754,247 | A | * | 6/1988 | Raymont et al. ..... 335/202 |
| 4,764,650 | A | | 8/1988 | Bur et al. |
| 4,768,007 | A | | 8/1988 | Mertz et al. |
| 4,780,786 | A | | 10/1988 | Weynachter et al. |
| 4,831,221 | A | | 5/1989 | Yu et al. |
| 4,870,531 | A | | 9/1989 | Danek |
| 4,883,931 | A | | 11/1989 | Batteux et al. |
| 4,884,047 | A | | 11/1989 | Baginski et al. |
| 4,884,164 | A | | 11/1989 | Dziura et al. |
| 4,900,882 | A | | 2/1990 | Bernard et al. |
| 4,910,485 | A | | 3/1990 | Bolongeat-Mobleu et al. |
| 4,914,541 | A | | 4/1990 | Tripodi et al. |
| 4,916,420 | A | | 4/1990 | Bartolo et al. |
| 4,916,421 | A | | 4/1990 | Pardini et al. |
| 4,926,282 | A | | 5/1990 | McGhie |
| 4,935,590 | A | | 6/1990 | Malkin et al. |
| 4,937,706 | A | | 6/1990 | Schueller et al. |
| 4,939,492 | A | | 7/1990 | Raso et al. |
| 4,943,691 | A | | 7/1990 | Mertz et al. |
| 4,943,888 | A | | 7/1990 | Jacob et al. |
| 4,950,855 | A | | 8/1990 | Bolonegeat-Mobleu et al. |
| 4,951,019 | A | | 8/1990 | Gula |
| 4,952,897 | A | | 8/1990 | Barnel et al. |
| 4,958,135 | A | | 9/1990 | Baginski et al. |
| 4,965,543 | A | | 10/1990 | Batteux |
| 4,983,788 | A | | 1/1991 | Pardini |
| 5,001,313 | A | | 3/1991 | Leclerq et al. |
| 5,004,878 | A | | 4/1991 | Seymour et al. |
| 5,015,983 | A | | 5/1991 | DeRosier et al. |
| 5,027,091 | A | * | 6/1991 | Lesslie et al. ..... 335/132 |
| 5,029,301 | A | | 7/1991 | Nebon et al. |
| 5,030,804 | A | | 7/1991 | Abri |
| 5,057,655 | A | | 10/1991 | Kersusan et al. |
| 5,077,627 | A | | 12/1991 | Fraisse |
| 5,083,081 | A | | 1/1992 | Barrault et al. |
| 5,095,183 | A | | 3/1992 | Raphard et al. |
| 5,103,198 | A | | 4/1992 | Morel et al. |
| 5,115,371 | A | | 5/1992 | Tripodi |
| 5,120,921 | A | | 6/1992 | DiMarco et al. |
| 5,132,865 | A | | 7/1992 | Mertz et al. |
| 5,138,121 | A | | 8/1992 | Streich et al. |
| 5,140,115 | A | | 8/1992 | Morris |
| 5,153,802 | A | | 10/1992 | Mertz et al. |
| 5,155,315 | A | | 10/1992 | Malkin et al. |
| 5,166,483 | A | | 11/1992 | Kersusan et al. |
| 5,172,087 | A | | 12/1992 | Castonguay et al. |
| 5,178,504 | A | | 1/1993 | Falchi |
| 5,184,717 | A | | 2/1993 | Chou et al. |
| 5,187,339 | A | | 2/1993 | Lissandrin |
| 5,198,956 | A | | 3/1993 | Dvorak |
| 5,200,724 | A | | 4/1993 | Gula et al. |
| 5,210,385 | A | | 5/1993 | Morel et al. |
| 5,239,150 | A | | 8/1993 | Bolongeat-Mobleu et al. |
| 5,260,533 | A | | 11/1993 | Livesey et al. |
| 5,262,744 | A | | 11/1993 | Arnold et al. |
| 5,280,144 | A | | 1/1994 | Bolongeat-Mobleu et al. |
| 5,281,776 | A | | 1/1994 | Morel et al. |
| 5,283,943 | A | | 2/1994 | Aguayo et al. |
| 5,296,660 | A | | 3/1994 | Morel et al. |
| 5,296,664 | A | | 3/1994 | Crookston et al. |
| 5,298,874 | A | | 3/1994 | Morel et al. |
| 5,300,907 | A | | 4/1994 | Nereau et al. |
| 5,310,971 | A | | 5/1994 | Vial et al. |
| 5,313,180 | A | | 5/1994 | Vial et al. |
| 5,317,471 | A | | 5/1994 | Izoard et al. |
| 5,331,500 | A | | 7/1994 | Corcoles et al. |
| 5,334,808 | A | | 8/1994 | Bur et al. |
| 5,341,191 | A | | 8/1994 | Crookston et al. |
| 5,347,096 | A | | 9/1994 | Bolongeat-Mobleu et al. |
| 5,347,097 | A | | 9/1994 | Bolongeat-Mobleu et al. |
| 5,350,892 | A | | 9/1994 | Rozier |
| 5,357,066 | A | | 10/1994 | Morel et al. |
| 5,357,068 | A | | 10/1994 | Rozier |
| 5,357,394 | A | | 10/1994 | Piney |
| 5,361,052 | A | | 11/1994 | Ferullo et al. |
| 5,373,130 | A | | 12/1994 | Barrault et al. |
| 5,379,013 | A | | 1/1995 | Coudert |
| 5,424,701 | A | | 6/1995 | Castonguary et al. |
| 5,438,176 | A | | 8/1995 | Bonnardel et al. |
| 5,440,088 | A | | 8/1995 | Coudert et al. |
| 5,449,871 | A | | 9/1995 | Batteux et al. |
| 5,450,048 | A | | 9/1995 | Leger et al. |
| 5,451,729 | A | | 9/1995 | Onderka et al. |
| 5,457,295 | A | | 10/1995 | Tanibe et al. |
| 5,467,069 | A | * | 11/1995 | Payet-Burin et al. ..... 335/42 |
| 5,469,121 | A | | 11/1995 | Payet-Burin |
| 5,475,558 | A | | 12/1995 | Barjonnet et al. |
| 5,477,016 | A | | 12/1995 | Baginski et al. |
| 5,479,143 | A | | 12/1995 | Payet-Burin |
| 5,483,212 | A | | 1/1996 | Lankuttis et al. |
| 5,485,343 | A | | 1/1996 | Santos et al. |
| D367,265 | S | | 2/1996 | Yamagata et al. |
| 5,493,083 | A | | 2/1996 | Olivier |
| 5,500,630 | A | * | 3/1996 | Edwards, Jr. et al. ..... 335/132 |
| 5,504,284 | A | | 4/1996 | Lazareth et al. |
| 5,504,290 | A | | 4/1996 | Baginski et al. |
| 5,510,761 | A | | 4/1996 | Boder et al. |
| 5,512,720 | A | | 4/1996 | Coudert et al. |
| 5,515,018 | A | | 5/1996 | DiMarco et al. |
| 5,519,561 | A | | 5/1996 | Mrenna et al. |
| 5,534,674 | A | | 7/1996 | Steffens |
| 5,534,832 | A | | 7/1996 | Duchemin et al. |
| 5,534,835 | A | | 7/1996 | McColloch et al. |
| 5,534,840 | A | | 7/1996 | Cuingnet |
| 5,539,168 | A | | 7/1996 | Linzenich |
| 5,543,595 | A | | 8/1996 | Mader et al. |
| 5,552,755 | A | | 9/1996 | Fello et al. |
| 5,581,219 | A | | 12/1996 | Nozawa et al. |
| 5,604,656 | A | | 2/1997 | Derrick et al. |

| | | | |
|---|---|---|---|
| 5,608,367 | A | 3/1997 | Zoller et al. |
| 5,784,233 | A | 7/1998 | Bastard et al. |
| 5,990,981 | A | 11/1999 | Thompson et al. |

FOREIGN PATENT DOCUMENTS

| | | | |
|---|---|---|---|
| EP | 0 140 761 | | 5/1985 |
| EP | 0 174 904 | | 3/1986 |
| EP | 0 196 241 | | 10/1986 |
| EP | 0 224 396 | | 6/1987 |
| EP | 0 235 479 | | 9/1987 |
| EP | 0 239 460 | | 9/1987 |
| EP | 0 258 090 | | 3/1988 |
| EP | 0 264 313 | | 4/1988 |
| EP | 0 264 314 | | 4/1988 |
| EP | 0 283 189 | | 9/1988 |
| EP | 0 283 358 | | 9/1988 |
| EP | 0 291 374 | | 11/1988 |
| EP | 0 295 155 | | 12/1988 |
| EP | 0 295 158 | | 12/1988 |
| EP | 0 309 923 | | 4/1989 |
| EP | 0 313 106 | | 4/1989 |
| EP | 0 313 422 | | 4/1989 |
| EP | 0 314 540 | | 5/1989 |
| EP | 0 331 586 | | 9/1989 |
| EP | 0 337 900 | | 10/1989 |
| EP | 0 342 133 | | 11/1989 |
| EP | 0 367 690 | | 5/1990 |
| EP | 0 371 887 | | 6/1990 |
| EP | 0 375 568 | | 6/1990 |
| EP | 0 394 144 | | 10/1990 |
| EP | 0 394 922 | | 10/1990 |
| EP | 0 399 282 | | 11/1990 |
| EP | 0 407 310 | | 1/1991 |
| EP | 0 452 230 | | 10/1991 |
| EP | 0 555 158 | | 8/1993 |
| EP | 0 560 697 | | 9/1993 |
| EP | 0 567 416 | | 10/1993 |
| EP | 0 595 730 | | 5/1994 |
| EP | 0 619 591 | | 10/1994 |
| EP | 0 665 569 | | 8/1995 |
| EP | 0 673 108 | A1 | 9/1995 |
| EP | 0 700 140 | | 3/1996 |
| EP | 0 889 498 | | 1/1999 |
| FR | 2 410 353 | | 6/1979 |
| FR | 2 512 582 | | 3/1983 |
| FR | 2 553 943 | | 4/1985 |
| FR | 2 592 998 | | 7/1987 |
| FR | 2 682 531 | | 4/1993 |
| FR | 2 697 670 | | 5/1994 |
| FR | 2 699 324 | | 6/1994 |
| FR | 2 714 771 | | 7/1995 |
| GB | 2 233 155 | | 1/1991 |
| WO | 92/00598 | | 1/1992 |
| WO | 92/05649 | | 4/1992 |
| WO | 94/00901 | | 1/1994 |

* cited by examiner

ACCESSORY AND RECESS IDENTIFICATION SYSTEM FOR CIRCUIT BREAKERS

BACKGROUND OF THE INVENTION

The present invention relates to circuit breakers and accessories, and more particularly relates to an identification system for circuit breakers and accessories.

Although essential functions of circuit breakers and their accessories are somewhat standard, the outward appearance and the internal functioning of circuit breakers and various accessories can differ in assorted brands and by various makers and manufacturers. Many accessories can be nearly identical in outward appearance except for a pin pattern in the back of the accessory which is used as a rejection scheme for properly fitting the accessory within a recess sharing the same pin pattern.

While a skilled professional electrician should eventually be able to differentiate accessories and their location for placement within a circuit breaker frame, initial confusion can be frustrating. For a less skilled electrician, this confusion can lead to the inability to properly place the accessories within the circuit breaker frame.

To solve the above-described problem, an electrician or end-user could try the accessory in each compartment of the circuit breaker frame until a mating compartment is found. Of course, this is tedious and could result in damage to either the accessory or compartment if the accessory is inadvertently forced into the wrong compartment. Alternatively, one could ask for help from a fellow electrician, find a manual to identify the solution, or contact the manufacturer for information. In either case, time is being spent unproductively.

BRIEF SUMMARY OF THE INVENTION

In an exemplary embodiment of the invention, a circuit breaker is disclosed comprising a molded frame, a circuit breaker accessory, a recess within the molded frame for accepting the circuit breaker accessory, a recess symbol adjacent the recess, and an accessory symbol positioned on the first accessory, the accessory symbol matching the recess symbol for identifying accessory placement within the molded frame.

The above-discussed and other features and advantages of the present invention will be appreciated and understood by those skilled in the art from the following detailed description and drawings.

Referring to the exemplary drawings wherein like elements are numbered alike in the several Figures:

DETAILED DESCRIPTION OF THE INVENTION

Figure 1:
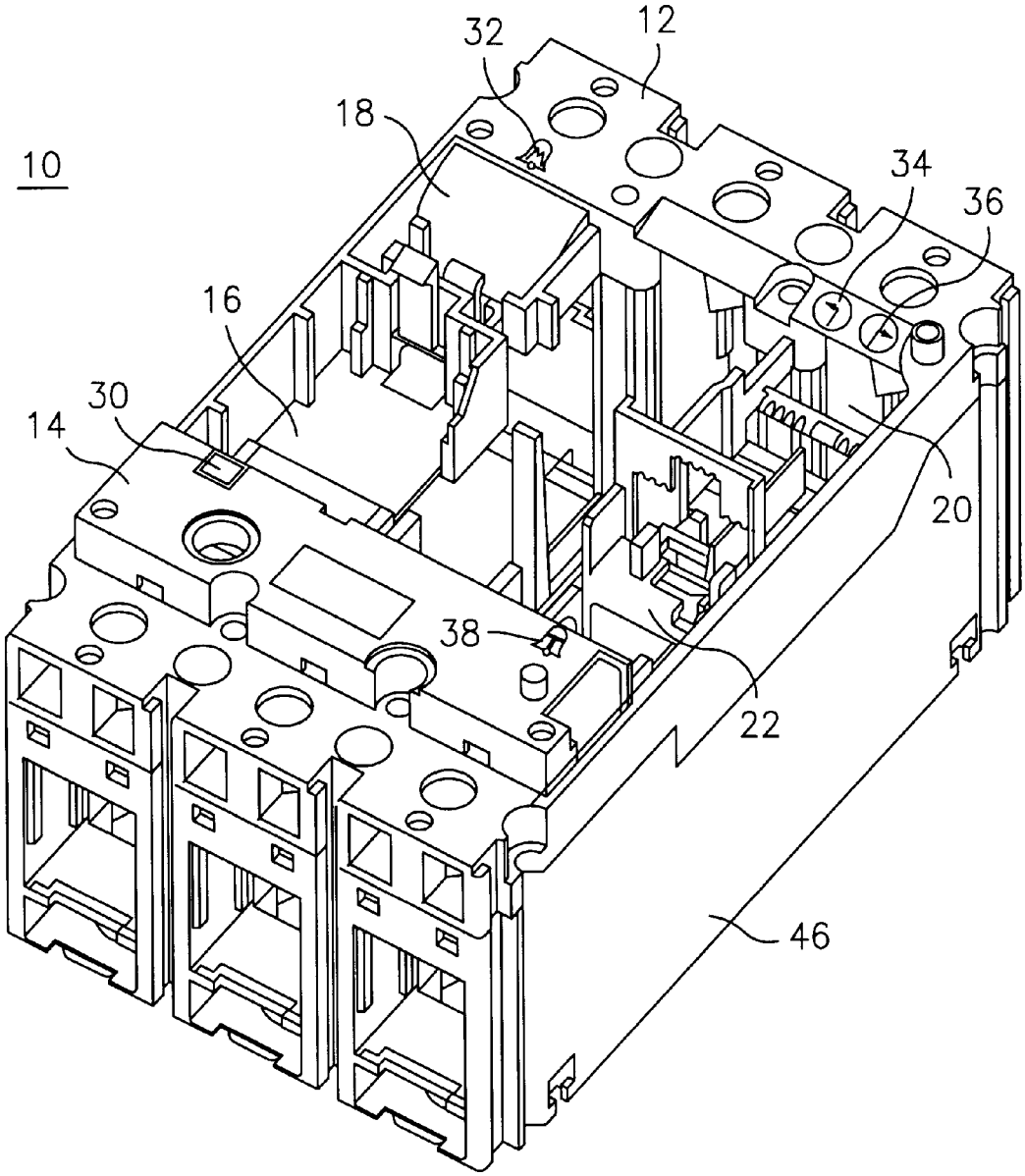
FIG. 1 shows a top perspective view of a circuit breaker having recesses for accommodating circuit breaker accessories and recess symbols adjacent the recesses.

As shown in FIG. 1, a circuit breaker 10 includes a molded frame 12 having a top surface 14 and a plurality of recesses, shown generally at 24, recessed from the top surface 14, and a base portion 46. The molded frame 12 is preferably made of plastic, or other suitable insulating material. Each recess 24 is adapted to accommodate a specific type of circuit breaker accessory. Recess 16 may accommodate either an under voltage release mechanism ("UVR") or a shunt trip ("SHT" or "ST"). A UVR is adapted to trip the breaker if the voltage drops more than 35%, and should not trip over 85% or more. The maximum reaction time for the UVR is 250 msec. An SHT trips the breaker if there is a fault in the line, with a reaction time of 15 msec from impulse to trip. Recess 18 may accommodate a bell alarm mechanism ("BAM") and recess 22 may accommodate a bell alarm trip ("BAT"). The BAM trips due to mechanical actuation of an operating mechanism and the BAT indicates when the circuit breaker trips because a fault has occurred. Recess 20 may accommodate an auxiliary switch ("AS"). An AS can be either normally open ("NO") or normally closed ("NC"). Upon a breaker trip event, the AS either closes (if normally open) or opens (if normally closed), allowing the AS to be used for any number of applications. An additional accessory that may be employed in a circuit breaker is an actuator ("ACT") which receives a signal from the electronic trip unit—if the trip unit detects an overcurrent condition, then the ACT trips the breaker by actuating a circuit breaker operating mechanism.

The identification system of the present invention may be utilized on different types of circuit breakers. Employing the identification system of the present invention into other circuit breakers not shown but having recesses for circuit breaker accessories are also within the scope of this invention.

Further shown in FIG. 1 are recess symbols, shown generally at 26, which are preferably molded into the molded frame 12. As shown, the symbols 26 may protrude from the top surface 14. Alternatively, the recess symbols 26 may be indented within the top surface 14. The protruding or indented nature of the recess symbols 26 is preferably accomplished by providing a mold having the shape of the recess symbols 26 therein such that the recess symbols 26 are molded directly into the molded frame 12 during the molding process. Thus, the symbols 26 are preferably tactile such that they cannot easily be worn off. For existing circuit breakers which are to be retrofitted with the identification system of the present invention, symbols 26 may be printed on the top surface 14 or applied to the top surface 14 through the use of adhesive labels.

The recess symbols 26 preferably each have an easily identifiable periphery that can be identified by both sight and touch. Some circuit breakers, such as circuit breaker 10, have very limited space upon top surface 14 to provide identifying indicia and therefore easy to identify shapes are preferred. The recess symbols 26 may be less than 5 mm wide and therefore peripheries which are easily distinguishable by sight and touch are preferred. Within the peripheries of the recess symbols 26 may be a single alphanumeric character or other identifying character such as an arrow to further identify the specific recess symbol 26.

Adjacent the recess 16 is a recess symbol 30 which, as shown, is a rectangle, and, more particularly may be a square. The periphery of a square is thus used to identify the recess 16 as a recess for either an under voltage release or a shunt trip. Adjacent the recess 18 is a recess symbol 32 which, as shown, may have a bell-shaped periphery with the letter "M" therein. The bell-shaped periphery with an interior M is thus used to identify the recess 18 as a recess for accommodating a bell alarm mechanism. Adjacent the recess 20 are recess symbols 34 and 36 which, as shown, each have a circular periphery. Within the circular periphery of each recess symbol 34 and 36 is an arrow. Recess symbol 34 has an arrow pointing to the left and recess symbol 36 has an arrow pointing to the right. Thus, the circular periphery with an interior arrow is used to identify the recess 20 as able to accommodate either type of auxiliary switch. Adjacent the recess 22 is a recess symbol 38 which, as shown, may have a bell-shaped periphery with the letter "T" therein. The bell-shaped periphery with an interior T is thus used to identify the recess 22 as a recess for accommodating a bell alarm trip.

Figure 2:
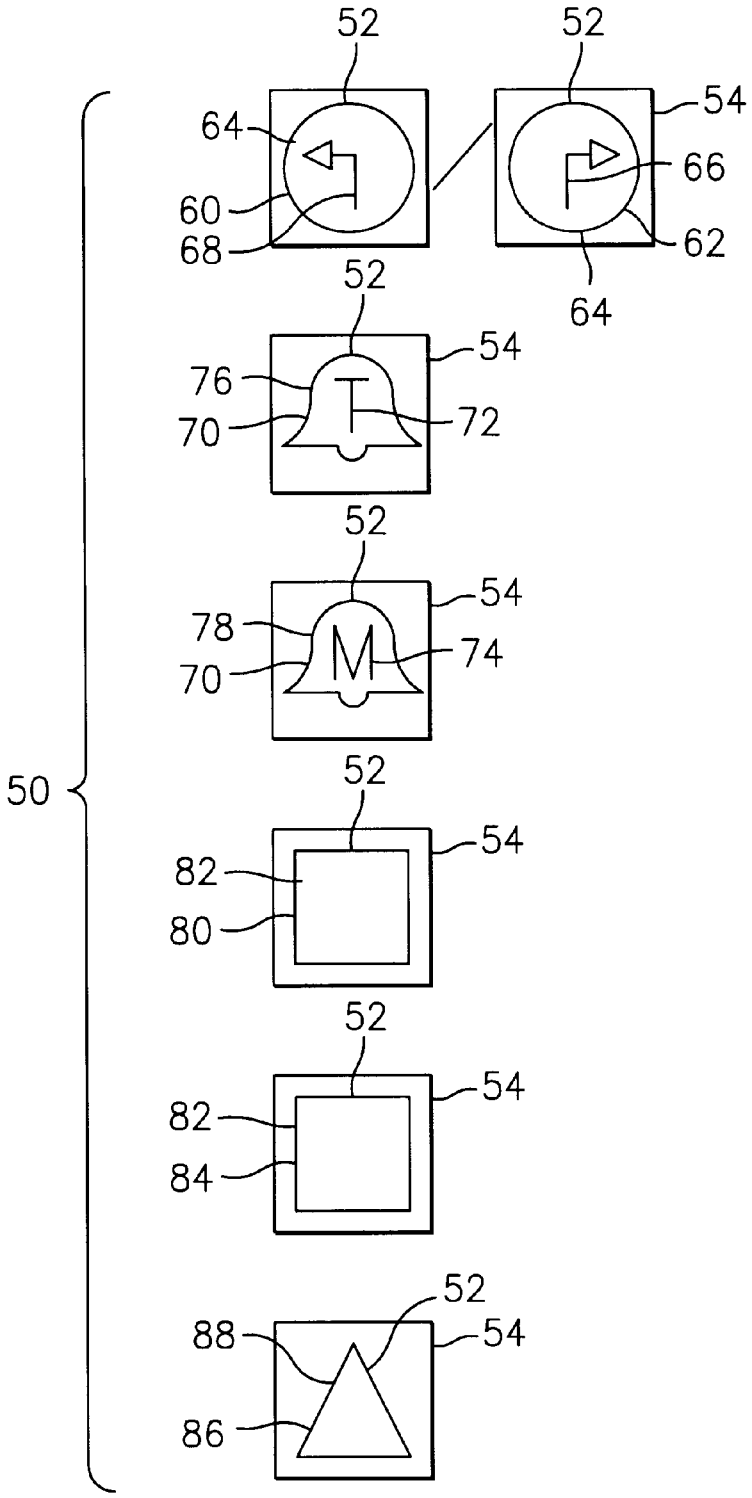
FIG. 2 shows a plan view of circuit breaker accessory symbol labels.

Although the above described recess symbols 26 enable the identification of recesses 24, it is further preferable to provide accessory symbols upon the circuit breaker accessories which match up the particular circuit breaker accessories with the recesses in which the accessories may be accommodated. Turning now to FIG. 2, symbol labels shown generally at 50 may be provided for attachment to respective circuit breaker accessories. Preferably, symbol labels 50 include an adhesive backing such that symbol labels 50 may be adhered to their respective circuit breaker accessories like a "sticker." Alternatively, the symbol labels 50 may have a gummed backing which becomes adhesive upon moistening, or the labels 50 may be taped or glued on in other conventional fashions. In any case, circuit breaker accessories may be retrofitted with the symbol labels 50. In yet another embodiment, the accessory symbols, shown generally at 52, may be directly molded or embossed into the surface of their respective circuit breaker accessories, although this would require an initial investment in mold changes for all circuit breaker accessories. If possible, the accessory symbols 52 could also be printed onto the surfaces of the circuit breaker accessories.

Referring again to FIG. 2, each accessory symbol 52 is shown provided (e.g. imprinted) on a suitably sized sheet 54. Preferably, the accessory symbols 52 match the recess symbols 26 for easily matching the circuit breaker accessories within the recesses 24. That is, the accessory symbols 52 may be identical, at least in appearance, to the recess symbols 26, although they may be larger or smaller than the recess symbols 26. The actual size of symbols 52 would be dictated by the allotted space upon the surfaces of the circuit breaker accessories. Preferably, the symbol labels 50 are placed upon a front surface of their respective accessories such that both accessory symbols 52 and recess symbols 26 are visible when insertion of a circuit breaker accessory is made into a recess 24, thus providing confirmation that the particular circuit breaker accessory has been installed within the proper recess or compartment 24.

FIG. 2 further shows accessory symbols 60 and 62 each having a circular periphery 64. The difference between accessory symbols 60 and 62 lies in the interior characters placed within the circular peripheries 64. That is, accessory symbol 60 is provided with a left directional arrow 68 and accessory symbol 62 is provided with a right directional arrow 66. Similarly, accessory symbols 76 and 78 are each provided with a bell-shaped periphery 70, however accessory symbol 76 has the character "T" 72 within the bell-shaped periphery 70 and accessory symbol 78 has the character "M" 74 within the bell-shaped periphery 70. Accessory symbols 80 and 84 may share the square shaped periphery 82, while accessory symbol 86 is provided with a triangular periphery 88.

Thus, accessory symbol 60 matches recess symbol 34, accessory symbol 62 matches recess symbol 36, accessory symbol 76 matches recess symbol 38, accessory symbol 78 matches recess symbol 32, accessory symbol 80 matches recess symbol 30, and accessory symbol 84 matches recess symbol 30. Although not shown, accessory symbol 86 preferably matches a recess symbol 26 provided upon a circuit breaker having a recess 24 for an actuator.

Figure 3:
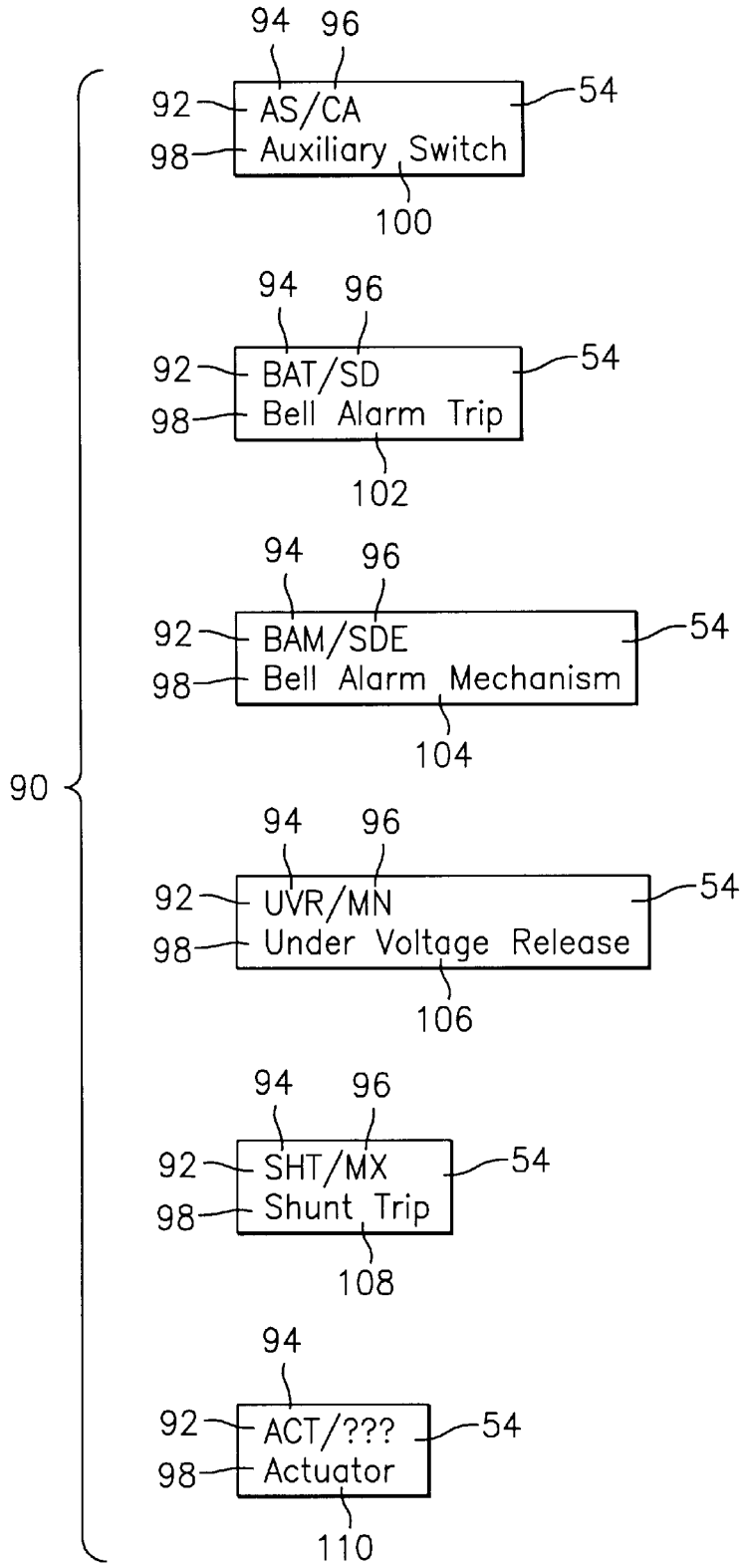
FIG. 3 shows a plan view of circuit breaker accessory name labels.

Turning now to FIG. 3, a plurality of name labels 90 are shown. These name labels 90 may be advantageously placed upon a side surface on a circuit breaker accessory to clearly identify the circuit breaker accessory. The name labels 90 may include sheets or other flat substrates 54 with adhesive qualities as previously described with respect to symbol labels 50. Alternatively, the information contained within each name label 90 may be provided upon the circuit breaker accessories in other manners as described above with respect to symbol labels 50. Upon each sheet 54, an acronym or abbreviation 92 of the name of the circuit breaker accessory is provided. Preferably, the acronym 92 includes a first acronym 94 of the circuit breaker accessory's name in a first language (e.g. English) and a second acronym 96 of the circuit breaker accessory's name in a second language (e.g. French). The first and second acronyms 94, 96 may be separated by a backslash, hyphen, space, or other suitable dividing character to clearly distinguish them apart from one another. If space permits, the circuit breaker's name 98 may also be provided on the name label 90.

As shown in FIG. 3, name label 100 is provided with the acronyms "AS/CA" and name "Auxiliary Switch", name label 102 is provided with the acronyms "BAT/SD" and the name "Bell Alarm Trip", name label 104 is provided with the acronyms "BAM/SDE" and the name "Bell Alarm Mechanism", name label 106 is provided with the acronyms "UVR/MN" and the name "Under Voltage Release", name label 108 is provided with the acronyms "SHT/MX" and the name "Shunt Trip", and name label 110 is provided acronyms "ACT/???" and the name "Actuator" (where ??? may be the French or other foreign language equivalent abbreviation for actuator).

Figure 4:
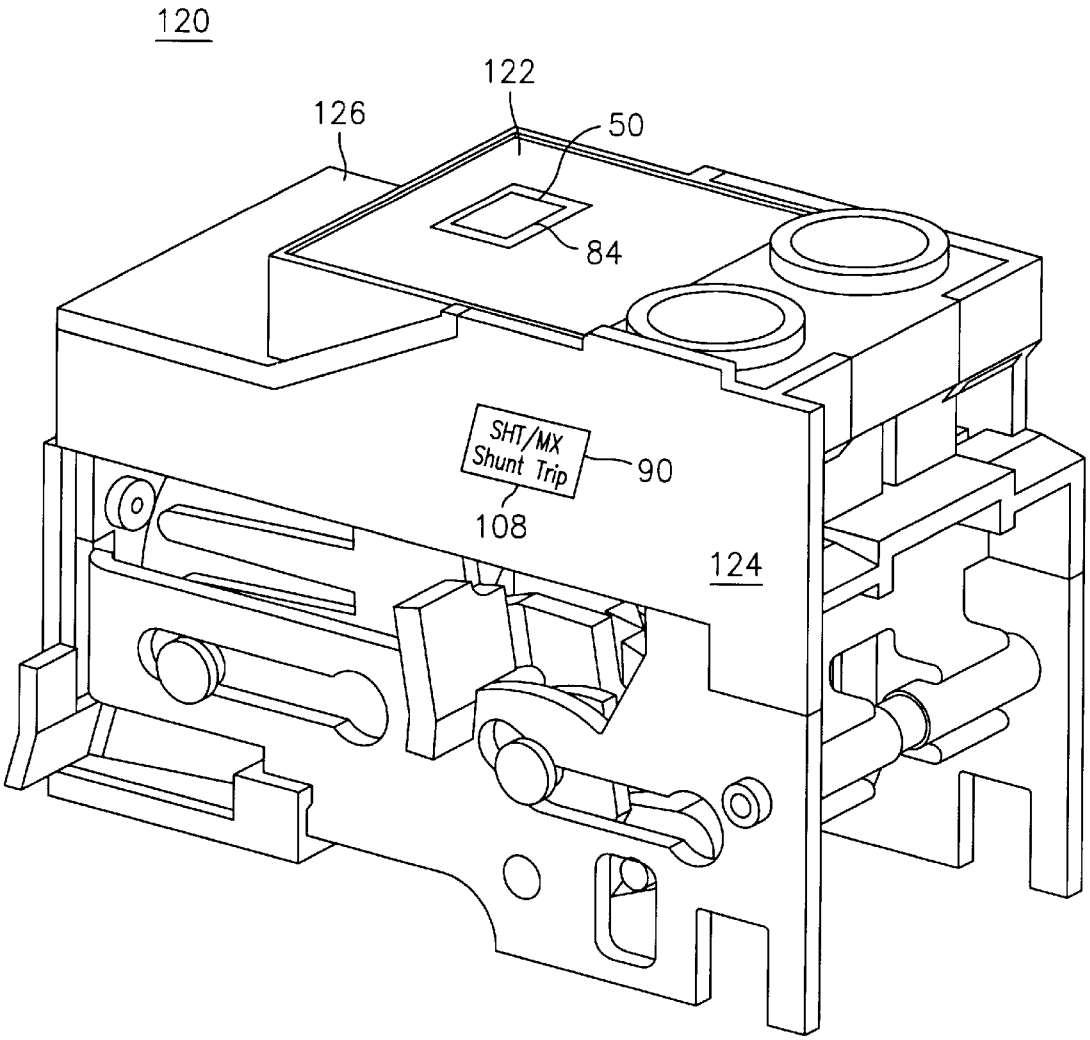
FIG. 4 shows a side perspective view of a circuit breaker accessory.
Figure 5:
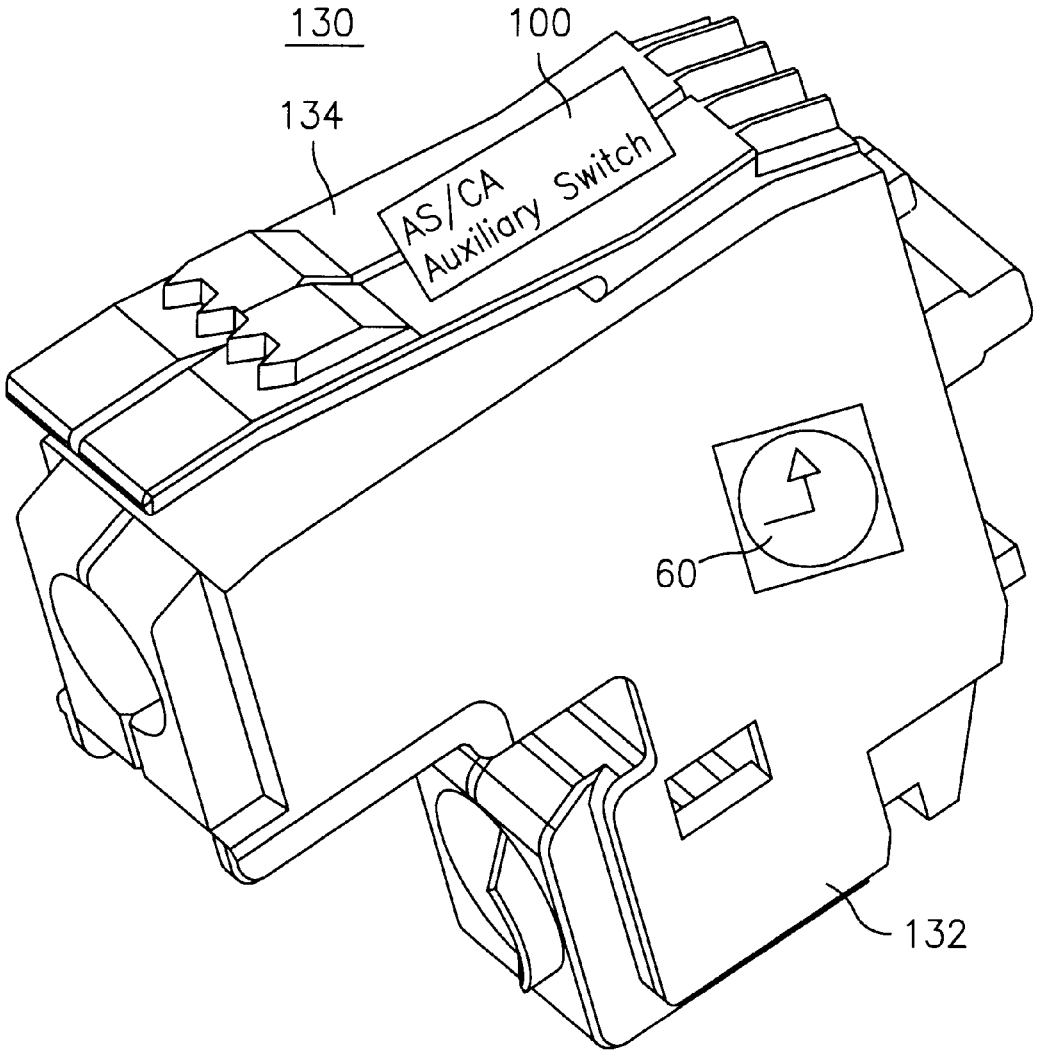
FIG. 5 shows a side perspective view of another circuit breaker accessory; and, FIG. 6 shows the circuit breaker of FIG. 1 housing the circuit breaker accessory of FIG. 4.

FIGS. 4 and 5 demonstrate exemplary circuit breaker accessories and their use of symbol labels 50 and name labels 90. The accessory 120 shown in FIG. 4 may be either an under voltage release, shunt trip, or an actuator because these accessories can share a similar exterior appearance. The difference between an under voltage release and a shunt trip may be internal only, and the difference between these two accessories and an actuator may be only an external rejection pin scheme. While the similarities between the accessories improve the manufacturing process of circuit breaker accessories, these accessories are so similar in appearance that confusion can easily occur. Thus, symbol label 50 is preferably provided on a front surface 122 of the accessory 120 and name label 90 is preferably provided on a side surface 124 of the accessory 120 to clearly identify the accessory 120. For example only, the accessory symbol 84 and name label 108 are shown on the surfaces 122 and 124, respectively. Surface 126 on accessory 120 could also carry accessory symbol 84 as that is also a front surface of the accessory 120. By "front surface", it is meant the surface which remains visible after insertion of accessory within the recess 24.

Turning now to FIG. 5, accessory 130 may be an auxiliary switch and is thus provided with one of the accessory symbols 60, 62 on front surface 132. The accessory symbol 60 having the left directional arrow is shown, for exemplary purposes. Name label 100 is placed on side surface 134 to identify the accessory 130 as an auxiliary switch.

Figure 6:
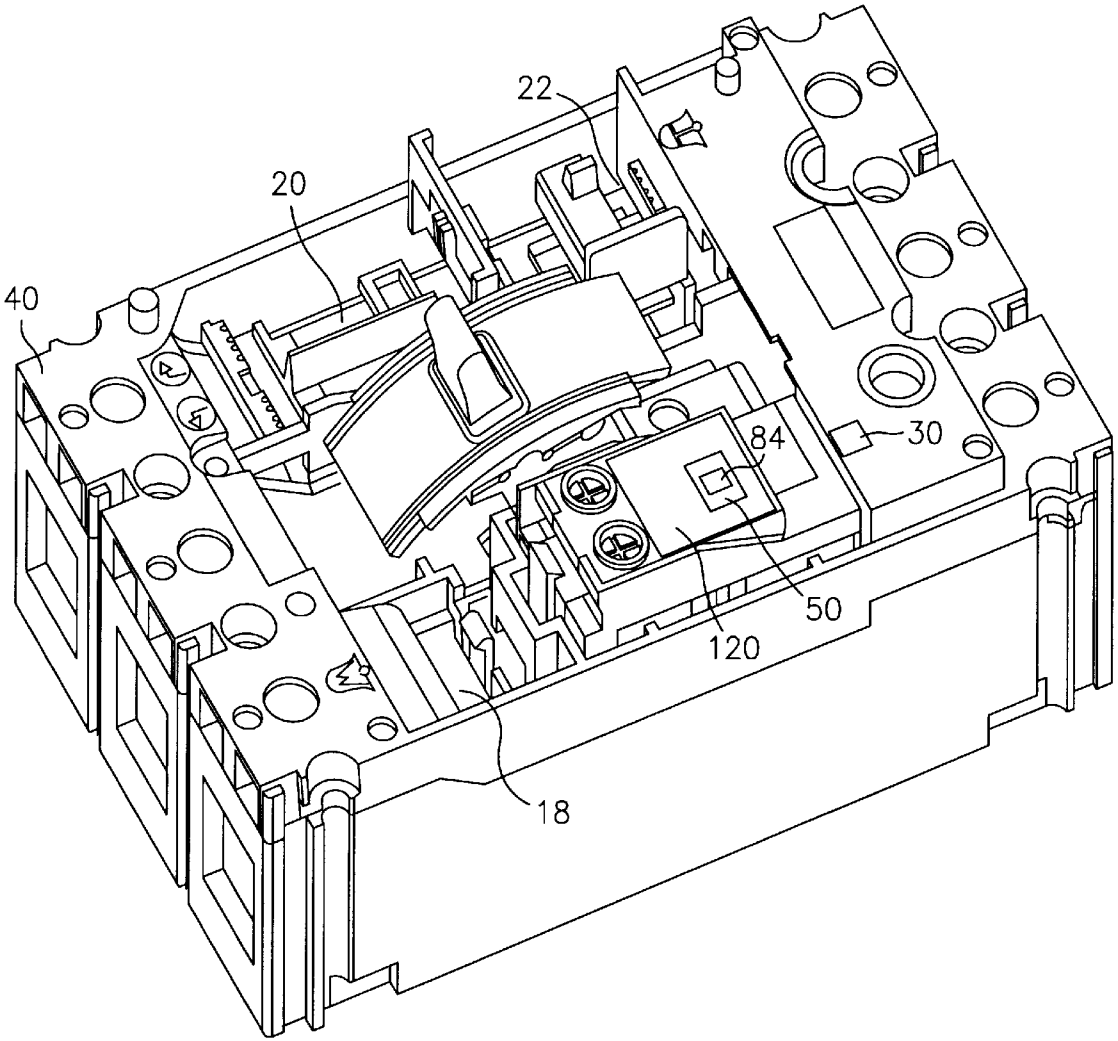

The identification system of the present invention is shown in use in FIG. 6, where an under voltage release or shunt trip 120 is shown correctly inserted within recess 16. To affirm correct positioning prior to placement, accessory symbol 84 may be compared to recess symbol 30. Since they "match", correct positioning of accessory 120 in recess 16 is confirmed. Whether an under voltage release or shunt trip is to be used may be confirmed by review of the name label 90 prior to insertion within the recess 16.

Thus, an identification system has been described which incorporates easy to understand symbols in the design of the circuit breaker frame and accessories to help customers properly install internal accessories. The symbols are meant to provide the customer with an easy way of matching the accessory to the proper compartment on the circuit breaker.

Of course, the above-described recess and accessory symbols 26, 52 are exemplary only and may be altered using different peripheries and/or characters as is deemed appropriate. Similarly, the acronyms and names displayed on name labels 90 may be changed to adequately describe the attached accessory in the appropriate language and with the amount of detail required by the end user.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circuit breaker system comprising:

a molded frame;

a first circuit breaker accessory;

a first recess within the molded frame for accepting the first circuit breaker accessory;

a first recess symbol adjacent the first recess;

a first accessory symbol positioned on the first accessory, the first accessory symbol matching the first recess symbol for identifying accessory placement within the molded frame;

a second circuit breaker accessory having a different construction than the first circuit breaker accessory;

a second recess within the molded frame for accepting the second circuit breaker accessory;

a second recess symbol, different than the first recess symbol, adjacent the second recess;

a second accessory symbol positioned on the second circuit breaker accessory, the second accessory symbol being different than the first accessory symbol and matching the second recess symbol for identifying placement of the second circuit breaker accessory within the molded frame.

2. The circuit breaker system of claim 1 further comprising:

a plurality of accessories, each having an identifying accessory symbol;

a plurality of recesses in the molded frame for accepting accessories, each recess having an adjacent recess symbol for identifying which type of accessory can be accepted therein;

wherein an accessory symbol of a chosen accessory matches a recess symbol of a selected recess when the chosen accessory is insertable within the selected recess; and wherein an accessory symbol of a chosen accessory does not match a recess symbol of a selected recess when the chosen accessory is not insertable within the selected recess.

3. The circuit breaker system of claim 2 wherein a matching pair of accessory and recess symbols comprise identical symbols.

4. The circuit breaker system of claim 1 wherein the first recess symbol is molded into the molded frame and the first accessory symbol is on a first label adhered to the first circuit breaker accessory.

5. The circuit breaker system of claim 4 wherein the first label is positioned on a front of the first circuit breaker accessory and visible when the first circuit breaker accessory is inserted into the first recess, the first circuit breaker accessory further comprising a second label positioned on a side of the first circuit breaker accessory, the second label containing the first circuit breaker accessory's name.

6. The circuit breaker system of claim 5 wherein the second label further comprises a first acronym of the first circuit breaker accessory's name in a first language and a second acronym of the first circuit breaker accessory's name in a second language.

7. The circuit breaker system of claim 1 wherein the first circuit breaker accessory is chosen from a set containing an auxiliary switch, bell alarm trip, bell alarm mechanism, under voltage release, shunt trip, and actuator.

8. The circuit breaker system of claim 7 wherein the first recess symbol and the first accessory symbol have a peripheral shape chosen from a set of shapes containing a circle, bell-shape, rectangle, and triangle.

9. A method for simplifying the installation process of internal accessories within a frame of a circuit breaker, the method comprising:

identifying each recess in the circuit breaker which may accommodate an accessory;

selecting a recess symbol for each recess, each recess symbol uniquely indicative of a type of accessory accommodatable therein;

providing each recess symbol upon the frame of the circuit breaker adjacent each respective recess;

selecting an accessory symbol for each accessory, each accessory symbol chosen to have a visually similar appearance as each recess symbol adjacent each recess in which each respective accessory is insertable;

providing each accessory symbol upon a front surface of each respective accessory wherein each accessory symbol and each recess symbol are visible upon the frame when each accessory is inserted within each recess.

10. The method of claim 9 wherein providing each recess symbol comprises molding each recess symbol in a surface of the frame adjacent each recess.

11. The method of claim 10 wherein providing each accessory symbol comprises placing each accessory symbol on a label and adhering each label to a front surface of its respective accessory.

12. The method of claim 11 further comprising placing each accessory's name on a name label and adhering each name label to a side surface of its respective accessory.

13. The method of claim 12 further comprising placing first and second acronyms corresponding to each accessory's name in first and second languages on each name label.

* * * * *